US011052281B2

(12) United States Patent
Saldate et al.

(10) Patent No.: US 11,052,281 B2
(45) Date of Patent: Jul. 6, 2021

(54) MULTI-PURPOSE EXERCISE DEVICE

(71) Applicants: Abran Saldate, Miami, FL (US); Justin Calsoncin, Severn, MD (US)

(72) Inventors: Abran Saldate, Miami, FL (US); Justin Calsoncin, Severn, MD (US)

( * ) Notice: Subject to any disclaimer, the term of this patent is extended or adjusted under 35 U.S.C. 154(b) by 0 days.

(21) Appl. No.: 16/456,651

(22) Filed: Jun. 28, 2019

(65) Prior Publication Data

US 2020/0023230 A1 Jan. 23, 2020

Related U.S. Application Data

(60) Provisional application No. 62/691,846, filed on Jun. 28, 2019.

(51) Int. Cl.
*A63B 21/00* (2006.01)
*A63B 21/06* (2006.01)
(Continued)

(52) U.S. Cl.
CPC ..... *A63B 21/4033* (2015.10); *A63B 21/0442* (2013.01); *A63B 21/0552* (2013.01);
(Continued)

(58) Field of Classification Search
CPC . A63B 21/4033; A63B 21/0609; A63B 21/08; A63B 21/0442; A63B 21/0724;
(Continued)

(56) References Cited

U.S. PATENT DOCUMENTS 4,029,312 A * 6/1977 Wright ..... A63B 21/0602 482/108
5,637,064 A * 6/1997 Olson ..... A63B 21/0728 482/107

(Continued)

FOREIGN PATENT DOCUMENTS

WO WO-2018018071 A1 * 2/2018 ..... A63B 21/0728

OTHER PUBLICATIONS

Screen captures from YouTube video clip entitled "Rock the Battle Ropes," 10 pages, uploaded on Nov. 13, 2012 by user "3V". Retrieved from the Internet: https://www.youtube.com/watch?v=5WZWWOrqUe4. (Year: 2012).*

(Continued)

*Primary Examiner* — Megan Anderson
*Assistant Examiner* — Kathleen Vermillera
(74) *Attorney, Agent, or Firm* — Beau Horner

(57) ABSTRACT

A multipurpose exercise device is provided. The device includes features which allow the device to exhibit self-stabilizing features. The device includes a weighted body characterized by at least three substantially-loop-shaped handles which have dimensions and arrangements that are effective to cooperatively urge the device into one of several predetermined self-stabilizing rest positions. The rest positions are characterized by engagement portions of two of the provided handles resting against a support surface, while an elongated device bore extending along a center axis of the device is maintained in a substantially-horizontal orientation. The device may be stored safely in a variety of arrangements, including on a rack typically used for dumbbell storage.

20 Claims, 19 Drawing Sheets

(51) Int. Cl.

| | |
|---|---|
| ***A63B 21/08*** | (2006.01) |
| ***A63B 23/02*** | (2006.01) |
| ***A63B 21/04*** | (2006.01) |
| ***A63B 23/12*** | (2006.01) |
| ***A63B 21/072*** | (2006.01) |
| ***A63B 21/055*** | (2006.01) |
| *A63B 22/00* | (2006.01) |

(52) U.S. Cl.
CPC ..... *A63B 21/0609* (2013.01); *A63B 21/072* (2013.01); *A63B 21/0724* (2013.01); *A63B 21/08* (2013.01); *A63B 23/0211* (2013.01); *A63B 23/1236* (2013.01); *A63B 23/1281* (2013.01); *A63B 2022/0079* (2013.01)

(58) Field of Classification Search
CPC ..... A63B 21/0552; A63B 21/4035; A63B 21/0722; A63B 21/072–075; A63B 23/0211; A63B 23/1236; A63B 23/1281; A63B 2022/0079; A63B 2023/0411; A63B 71/0036; A63B 71/0054; A63B 2208/0252; A63B 2208/0214; A63B 2209/00
See application file for complete search history.

(56) References Cited

U.S. PATENT DOCUMENTS

| | | | | |
|---|---|---|---|---|
| 6,068,580 | A * | 5/2000 | Myers | A63B 21/02 446/220 |
| 9,616,269 | B1 * | 4/2017 | Burosh | A63B 21/072 |
| 9,844,695 | B1 * | 12/2017 | Shorter | A63B 21/4035 |
| 10,179,259 | B1 * | 1/2019 | Zagata | A63B 21/4035 |
| 10,420,979 | B2 * | 9/2019 | Estrada, Jr. | A63B 21/4043 |
| 10,449,404 | B2 * | 10/2019 | Wood | A63B 21/0004 |
| D878,493 | S * | 3/2020 | Katayama | D21/658 |
| 2007/0238578 | A1 * | 10/2007 | Landfair | A63B 21/072 482/44 |
| 2011/0263393 | A1 * | 10/2011 | Ross | A63B 21/0724 482/93 |
| 2013/0012367 | A1 * | 1/2013 | Williams | A63B 21/072 482/108 |
| 2013/0331746 | A1 * | 12/2013 | Brown | A63B 23/03583 601/46 |
| 2014/0194258 | A1 * | 7/2014 | Shorter | A63B 21/072 482/93 |
| 2015/0360074 | A1 * | 12/2015 | Jung | A63B 21/0726 482/108 |
| 2017/0050073 | A1 * | 2/2017 | Kao | A63B 21/0728 |
| 2018/0133539 | A1 * | 5/2018 | Hudson | A63B 21/0726 |

OTHER PUBLICATIONS

Screen captures from YouTube video clip entitled "Chaos Kettlebell Biceps Curl," 6 pages, uploaded on Oct. 25, 2013 by user "RoyPumphrey." Retrieved from the Internet: https://www.youtube.com/watch?v=Mv06a5nlcdE. (Year: 2013).*

Screen captures from YouTube video clip entitled "How To: Bent Over Barbell Row," 6 pages, uploaded on Mar. 25, 2012 by user "Gabriel Sey". Retrieved from Internet: https://www.youtube.com/watch?v=vT2GjY_Umpw. (Year: 2012).*

Screen captures from YouTube video clip entitled "Bent Over Two-Arm Long Bar Row Exercise Guide and Video.mp4," 7 pages, uploaded on Aug. 18, 2010 by user "nb023". Retrieved from Internet: https://www.youtube.com/watch?v=0k2Lo3vR-44 (Year: 2010).*

Screen captures from YouTube video clip entitled "How To: Deadlift," 9 pages, uploaded on Feb. 20, 2012 by user "Gabriel Sey ". Retrieved from Internet: https://www.youtube.com/watch?v=RyJbvWAh6ec. (Year: 2012).*

"HAVAK | Triads"; http://havyk.net/products/havyktriad; capture date = Jul. 28, 2019; publication date = May 23, 2019.

"HAVYK Triad | Adjustable Hand Weights I Rogue Fitness"; https://www.roguefitness.com/havyk-triad; capture date = Jul. 28, 2019; publication date = Jul. 17, 2017.

* cited by examiner

MULTI-PURPOSE EXERCISE DEVICE

CROSS-REFERENCE TO RELATED APPLICATIONS

This application claims the benefit of provisional patent application Ser. No. 62/691,846, filed Jun. 29, 2018 by the present inventor(s), which is incorporated by reference in its entirety.

FIELD OF THE INVENTION

The device relates generally to the field of weight training equipment. More specifically, the device relates to a multi-purpose exercise device that may be used by itself or with other components to perform a variety of exercises and which have multiple storage options.

BACKGROUND

Resistance training is very popular around the world, with millions of people using it for recreational purposes and for maintaining a healthy lifestyle. In some types of resistance training, objects of known weight are lifted to develop targeted muscles; in other types, body weight is used, and in still others, resistance bands are used. Many types of purpose-built training devices exist to allow a user to perform various exercises of each type. Equipment such as fixed-weight dumbbells, kettlebells, and barbells adapted for use with plates of varying weight to accommodate weight training exercises; push up platforms, dip stations, crunch and sit-up bars accommodate body-weight exercises; and elastomeric bands can be attached to fixed and movable anchor locations and then elongated to facilitate training.

In order to provide an opportunity to accommodate a broad range of exercises, a person or gym needs to store multiple variations of training equipment to provide different weight, resistance, and body-supporting device calibrations, resulting in increased purchase costs and increased amounts of storage dedicated for each type of equipment. These requirements make using known equipment for a variety of exercises costly both in terms of capital investment and space required.

Additionally, although some multi-purpose equipment is known, typical multi-purpose devices are only marginally suited for more than one activity, often exhibiting low-suitability for some or all of their intended purposes in exchange for increased flexibility of use. Unfortunately, while known devices may be used for a variety of exercises, such uses they are often sub-optimized for all of them or require large investments of space or capital.

What is needed in this field is a device that is equally well-suited for a variety resistance-based training activities, including weightlifting, traditional kettlebell activities, dips, pull ups, sit up, crunches, assisted pushups, and resistance-band exercises.

SUMMARY

The present apparatus is a multi-purpose exercise device having a spherical, weighted body made of a high-density material, a central bore extending axially through a center of the body, and at least three handles extending outwardly from the body.

In one embodiment, the handles further comprise a center engagement portion, and a pair of arm spacing portions extending from opposite ends of the engagement portion to connect the engagement portion to the body and form a loop. The center engagement portion may include a textured knurling pattern, and the handles are sized and shaped to provide multiple, self-stabilizing orientations during use and when at rest.

The multi-purpose exercise device may be used to allow a user to perform a variety exercises, with the size and orientation of the handles being effective to provide a plurality of self-stabilizing resting positions that maintain the device central axis in a substantially-horizontal orientation. Each of the resting positions is characterized by the engagement portion of two handles being oriented for simultaneous support by a horizontally-aligned support surface, such as the ground or a workout environment floor.

BRIEF DESCRIPTION OF THE DRAWINGS

The particular objects and features of the present device, as well as the advantages, will become apparent from the following description taken in conjunction with the accompanying drawings in which.

DETAILED DESCRIPTION OF PREFERRED EMBODIMENTS

The present device will now be described more fully with reference to the accompanying drawings in which a preferred embodiment of the disclosure is shown. The disclosure may, however, be embodied in many different forms and should not be construed as being limited to the embodiment set forth herein.

Figure 1:
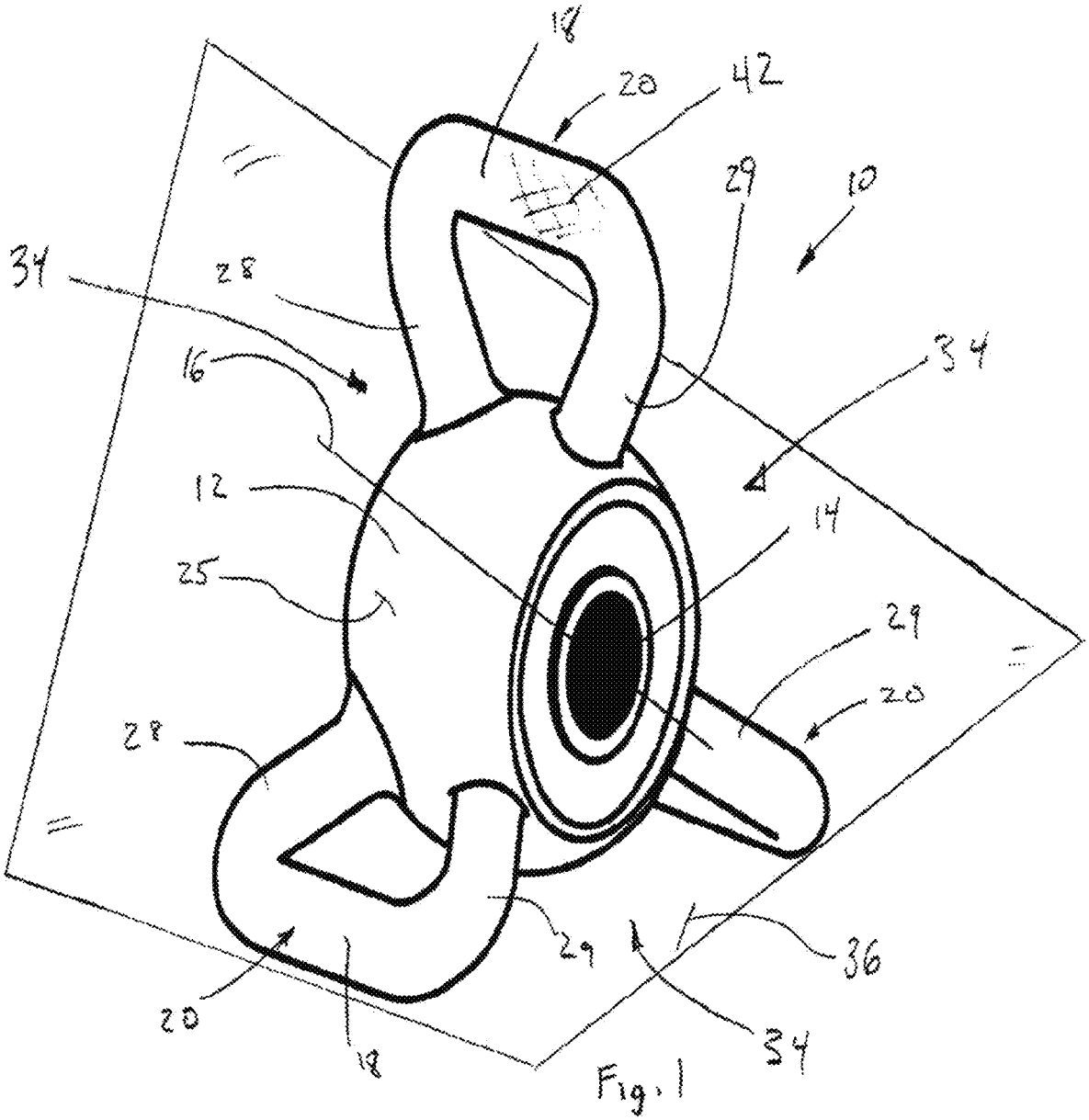
FIG. 1 is a perspective view illustrating a multi-purpose exercise device according to one embodiment of the device.

Referring now to FIG. 1, the apparatus described herein is a multi-purpose exercise device 10 comprising a weighted 12 body, a center bore 14 extending axially along a centerline or central axis 16 of the weighted body, and at least three handles 20 extending outwardly from a perimeter of the body. In one embodiment, each of the handles 20 is loop shaped and includes an elongated engagement portion 18, with first and second arm spacing portions 28, 29 extending from opposite ends of the engagement portion 18. The first and second arm spacing portions 28, 29 couple the engagement portion to the body 12.

Figure 2A:
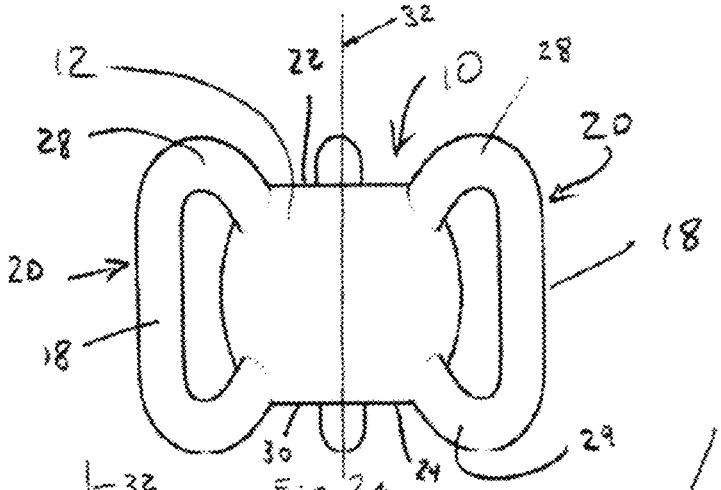
FIG. 2A is a bottom view of the device shown in FIG. 1.
Figure 2B:
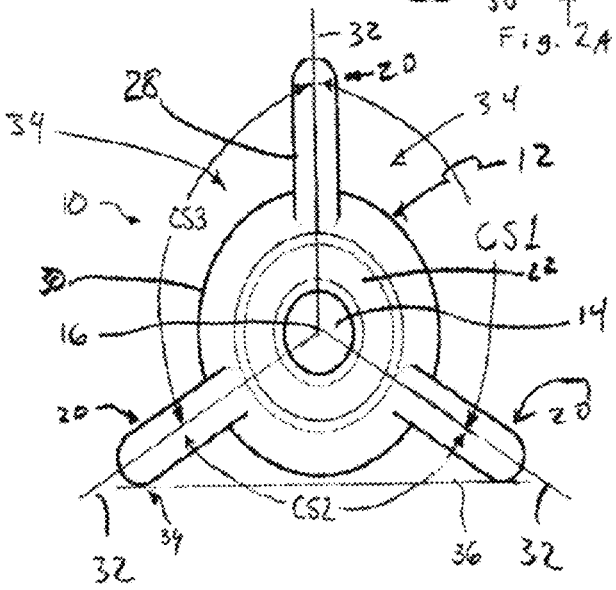
FIG. 2B is an end view of the device shown in FIG. 1.
Figure 2C:
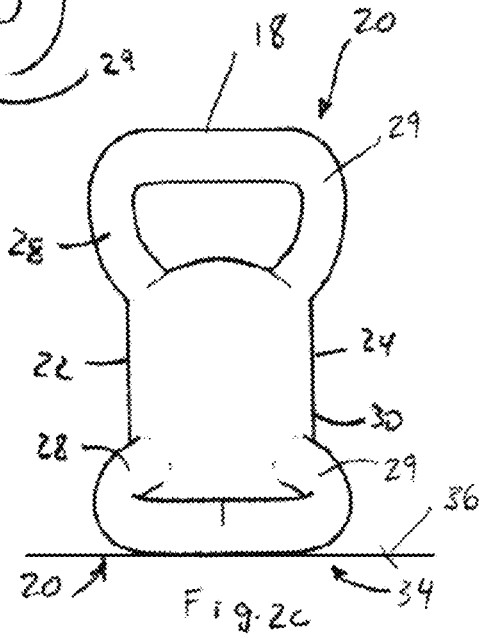
FIG. 2C is a side view of the device shown in FIG. 1.

As shown with continued reference to FIG. 1, and with additional reference to FIGS. 2A, 2B and 2C, the device body 12 is preferably a frusto-spherical shape, including a first end surface 22 and an opposite second end surface 24. As noted above, the elongated bore 14 extends between the first and second end surfaces, through the body 12, aligned generally along the central axis 16. In one embodiment, the first and second end surfaces 22,24 are generally flat; they may, however be slightly concave or convex.

With reference to FIG. 2, the device body 12 is preferably constructed of a high-density material, such as metal, and may be coated in a protective covering 25. The protective covering 25 may be paint, a polyurethane or rubber material, or any other protective coating not enumerated herein. The body 12 may be formed in several sizes, offering a range of sizes to provide different standard weights commonly used in weight training.

Now with collective reference to FIGS. 1, 2A, 2B, 2C, and 3, the handles 20 of embodiments of the this device 10, 11 are sized and positioned to allow the device to rest in a self-stabilizing rest position 34 when placed on the ground or other support surface 36, with each handle generally aligned along a respective handle orientation plane 32 and with two of the handles being at rest and supported by a selected support surface 36.

With particular reference to FIG. 1, FIGS. 2A, 2B, and 2C, the circumferential spacing of the orientation planes 32 of a three-handled embodiment of the device 10 is such that the planes are spaced substantially-equidistant around the circumference of the spherical body 12. That is, the orientation planes 32 for these handles 20 are spaced apart circumferentially with a respective arc CS1, CS2, CS3 of about 120° between them. With this arrangement, the device is especially-stable and will self-stabilize, with engagement portions 18 of two of the three handles 20 coming to rest on a selected support surface 36, such as the ground, a workout floor, a table, or other generally-horizontal surface. It noted that a plurality of self-stabilizing rest positions is available, each being characterized by any two of the three handles 20 being positioned and arranged to engage the selected support surface 36. It is noted that the orientation planes 32 of this embodiment preferably pass through the central axis of the body, but this is not required. It is also noted that the orientation planes 32 need not be spaced apart by 120°.

Figure 3:
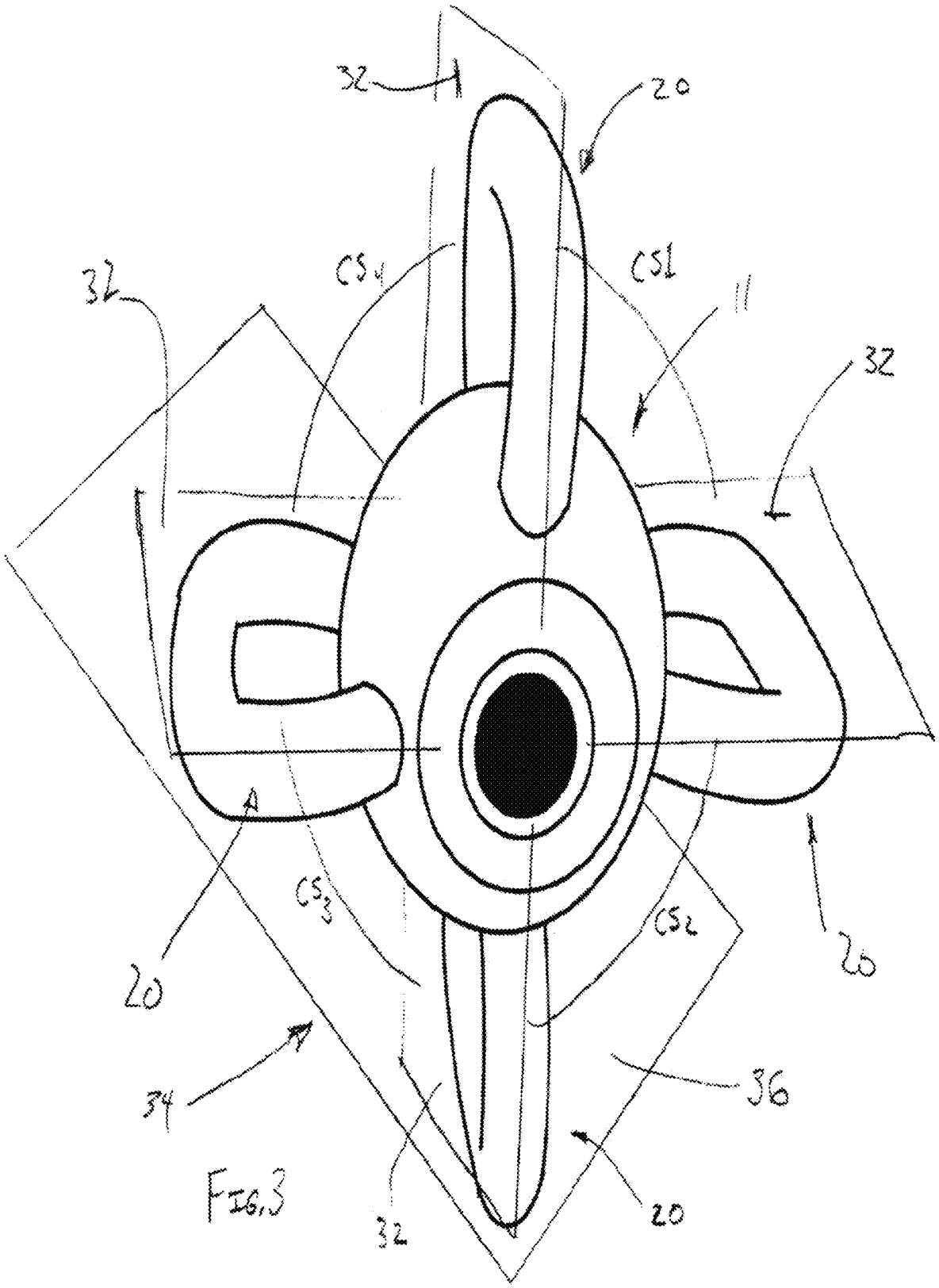
FIG. 3 is a perspective view of an alternate, four-handled embodiment of the device.

In a similar fashion, and with particular reference to FIG. 3, a four-handled version of the device 11 is shown at rest on a selected support surface 36, such as the ground, a table, or similar, generally-horizontal surface. In this embodiment, the circumferential spacing of the orientation planes 32 of a four-handled embodiment of the device 11 is such that the orientation planes are spaced substantially-equidistant around the circumference of the spherical body 12. That is, the orientation planes 32 for these handles 20 are spaced apart circumferentially with an arc CS1, CS2, CS3, and CS4 of about 90° between them. With this arrangement, the device is especially-stable and will self-stabilize, with engagement portions 18 of two of the four handles 20 coming to rest on a selected support surface 36, such as the ground, a table, or similar, generally-horizontal surface. It noted that a plurality of self-stabilizing rest positions is available, each being characterized by any two of the four handles 20 being positioned and arranged in to engage the selected support surface 36. It is noted that the orientation planes 32 of this embodiment preferably pass through the central axis 16 of the body, but this is not required. It is also noted that the orientation planes 32 need not be spaced apart by 90°.

As used herein, the term "self-stabilizing rest position" refers to a position in which an embodiment of this device 10, 11 will come to rest with engagement portions 18 of at least two handles 20 in an orientation that places and maintains the central axis 16 of the body 12 in a substantially-horizontal orientation. The handles 20 of this device 10,11 are constructed and arranged with dimensions effective to provide a plurality of self-stabilizing rest positions.

With additional reference to FIGS. 2A, 2B, and 2C, the engagement portion of the handles 20 are generally coplanar, each preferably lying substantially within a respective orientation plane 32 that corresponds to one of the device handles 20.

Figure 4:
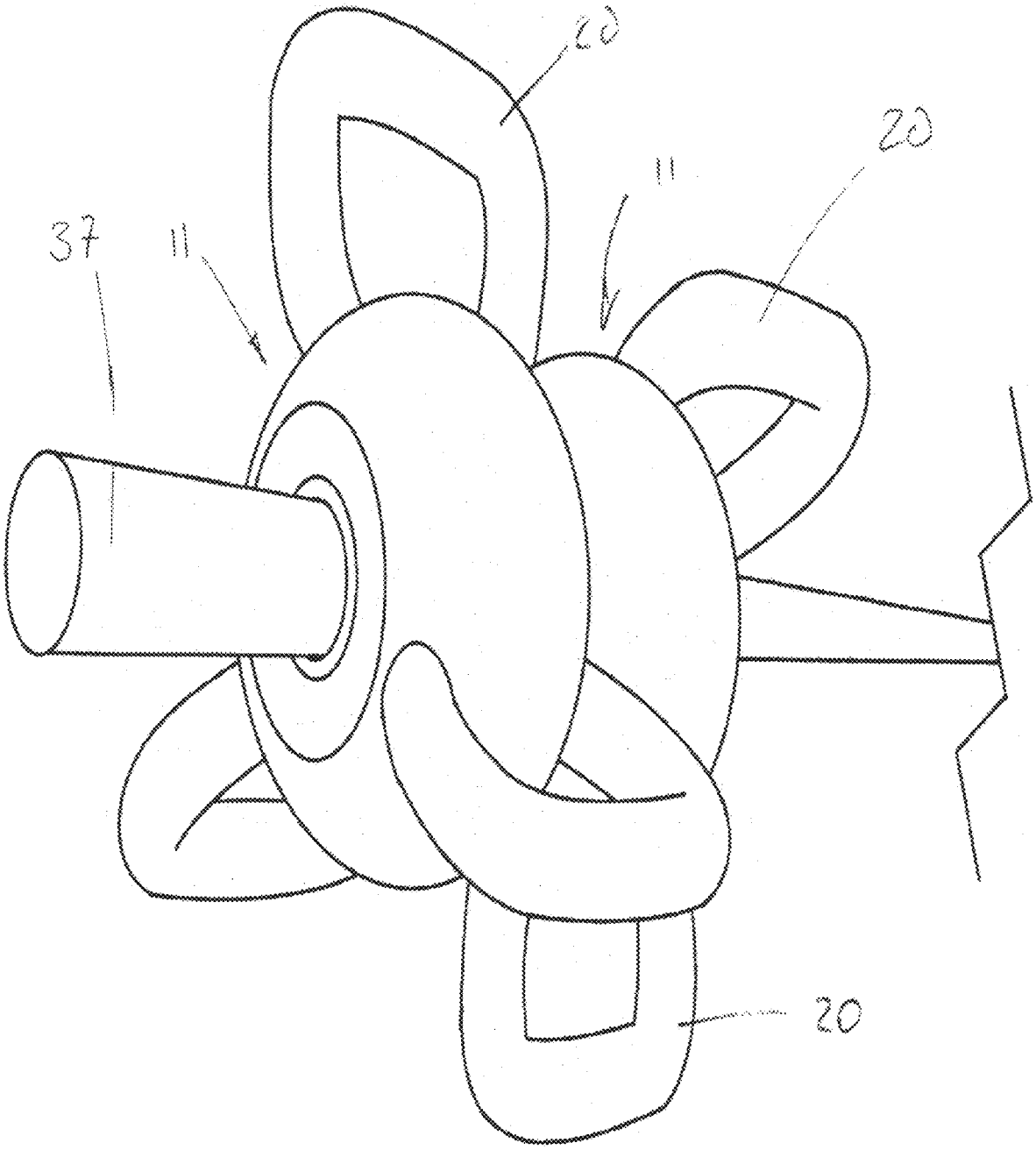
FIG. 4 is a perspective view of two of the devices loaded on a barbell.

As shown in FIG. 4, the center bore is preferably sized to accept standard sized barbell sleeves. Standard barbell sleeves typically have an outside diameter of 2 inches, but can vary from as little as 1 inch to as much as 2.5 inches. Therefore, the inside diameter of the center bore will preferably be in the range of about 1 inch to about 2.5 inches.

Figure 9:
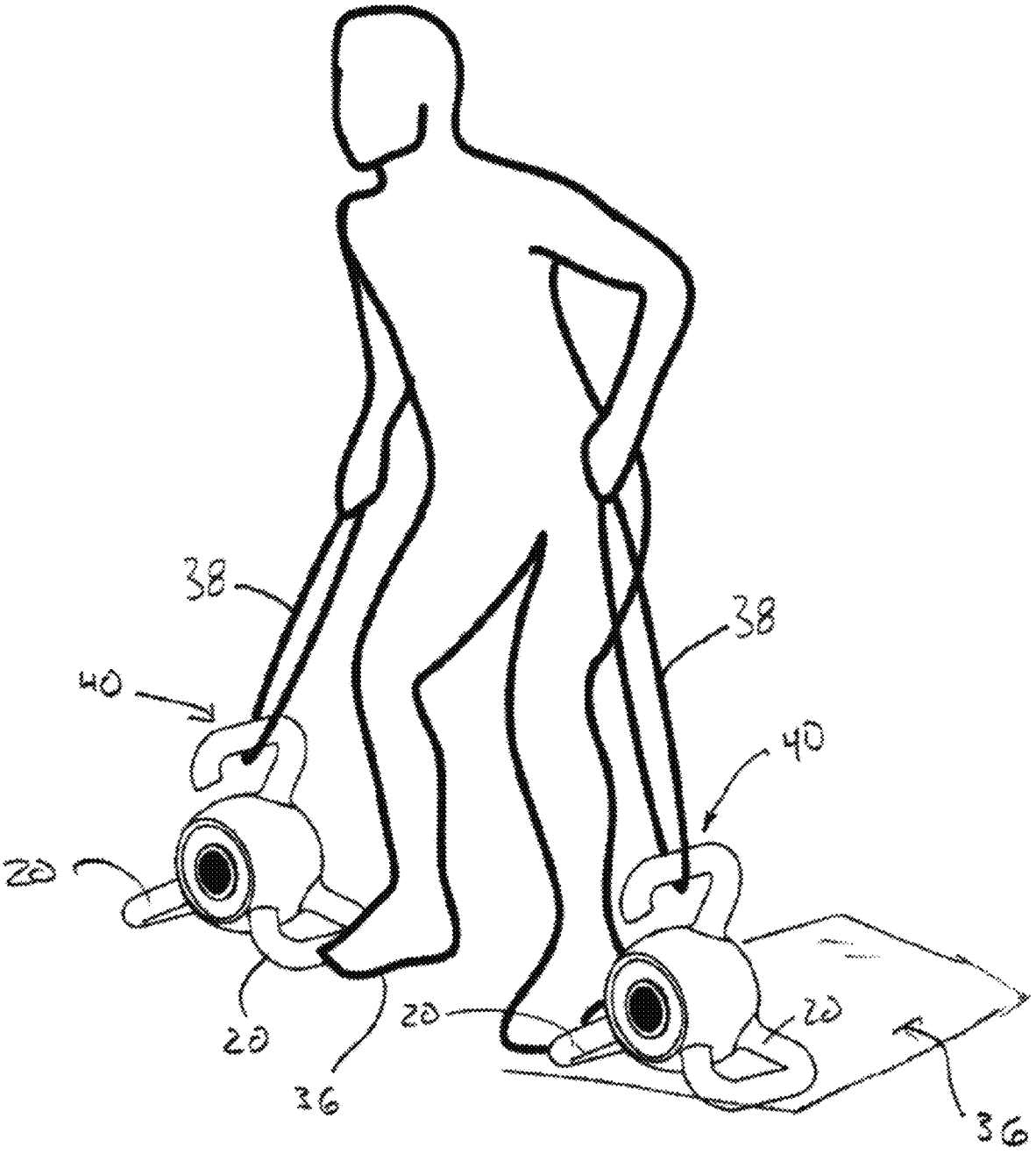
FIG. 9 is a schematic view of the present exercise device being used to perform a bicep curl exercise.

As further shown in FIG. 1, the handle preferably extends outwardly from the periphery of the body 12 such that the handles form an outside edge of a kettlebell-style weight-lifting device. The handle 10 is coupled to the weight plate body such that a loop is preferably formed perpendicular to the bore 16 of the body 12. The spacing portions 28,29 of the handle 20 may be rounded or multi-faceted and are structured to hold the weight of the entire body 12 without buckling. As shown in FIG. 9, the handle 40 need not be a contiguous loop, as a hook-shaped handle 40 may also suffice. With continued reference to FIG. 9, a hook-shaped handle 40 is especially-convenient for attaching looped resistance bands for use during elastomeric-resistance-based exercises.

With reference once again to FIG. 1, the engagement portion of the handle may include a textured surface 42 for a user to hold the device 10 securely. The engagement portion texture may be formed as a knurling pattern etched into the material, or it may include additional material, such as a rubber coating (not shown) that covers the center engagement portion.

As noted above and as shown in FIG. 4, the device 10 includes a plurality of handles 20 spaced around body 12, allowing the device to sit on the floor or other support surface 36. The plurality of handles is preferably arranged such that the sets of engagement portions 18 of the handles 20 provides positive contact surfaces that characterize stable rest positions, wherein the device may come to rest against the support surface 36 even if the device is loaded onto a barbell 37. The elongated bore 14 of the device 10 is preferably sized to accept a standard weight training barbell 37.

Figure 5:
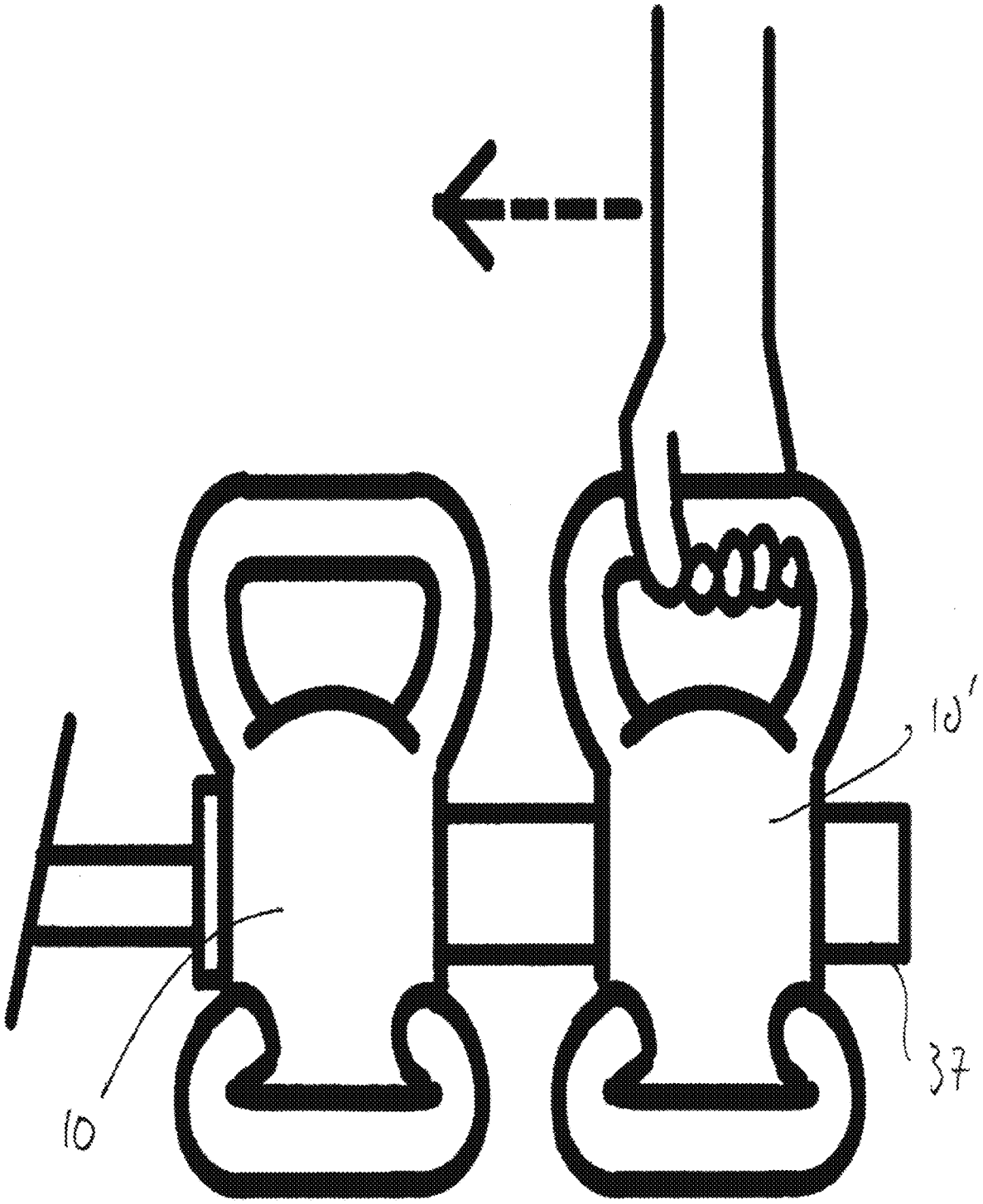
FIG. 5 is a side view of the exercise device showing a safety feature.

As further shown in FIGS. 4 and 5, the device 10 may be configured to allow multiple iterations of the device 10 to be loaded onto a barbell 37 for standard barbell exercises. With particular reference to an embodiment shown in FIG. 5, two iterations of the device 10 may be slid along a barbell 37 with relative safety for a user's hand 44, due to the relative spacing of the handle engagement portion 18 and associated spacing portions 28,29 of adjacent iterations of the device.

The present device 10 is well-suited for providing selectively-oriented resistance sources to efficiently allow a variety exercises to be performed safely, with reduced equipment requirements. Use of the device 10,11 in a variety of exemplary exercises will now be described.

Figure 6A:
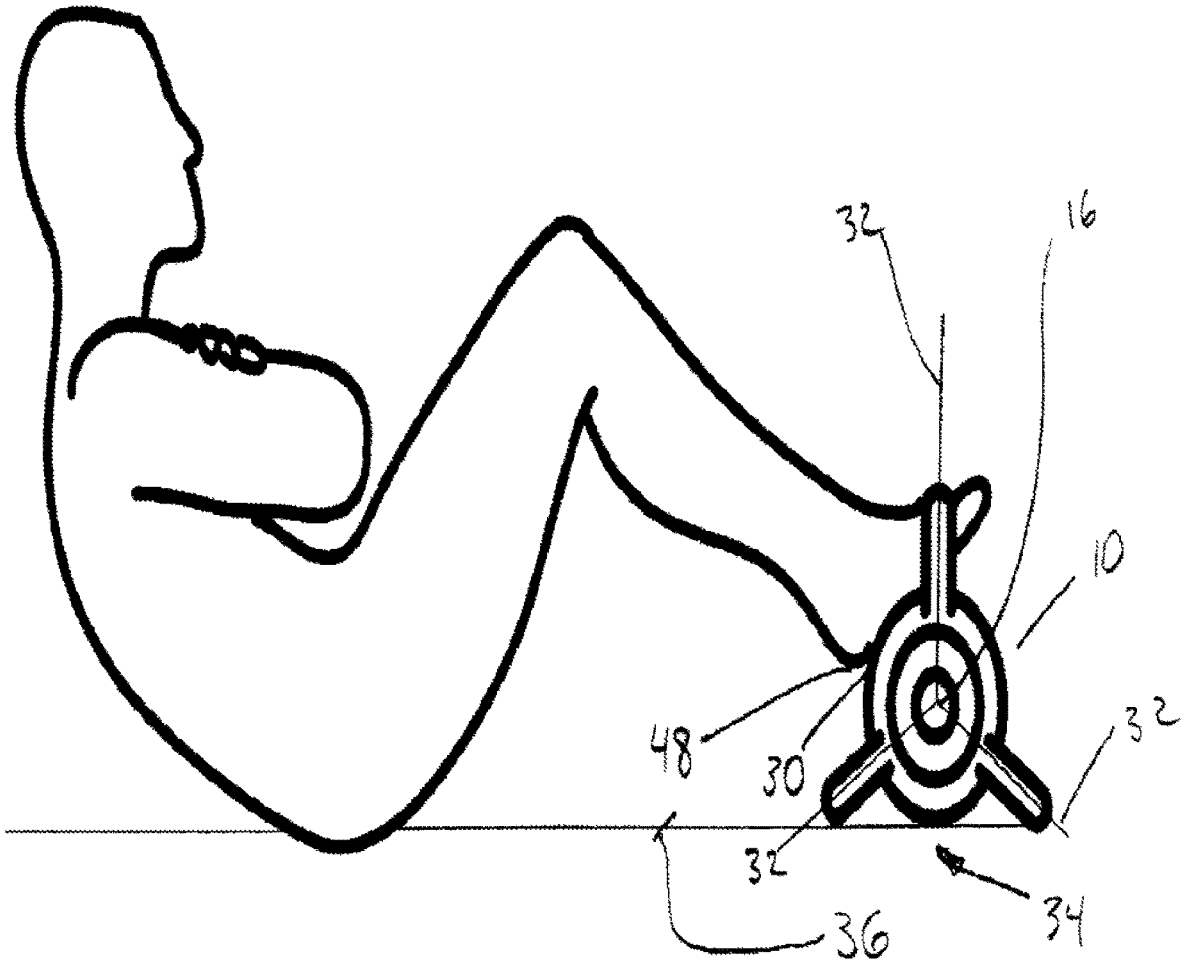
FIG. 6A is a schematic view of the present exercise device being used to perform a sit-up exercise.
Figure 6B:
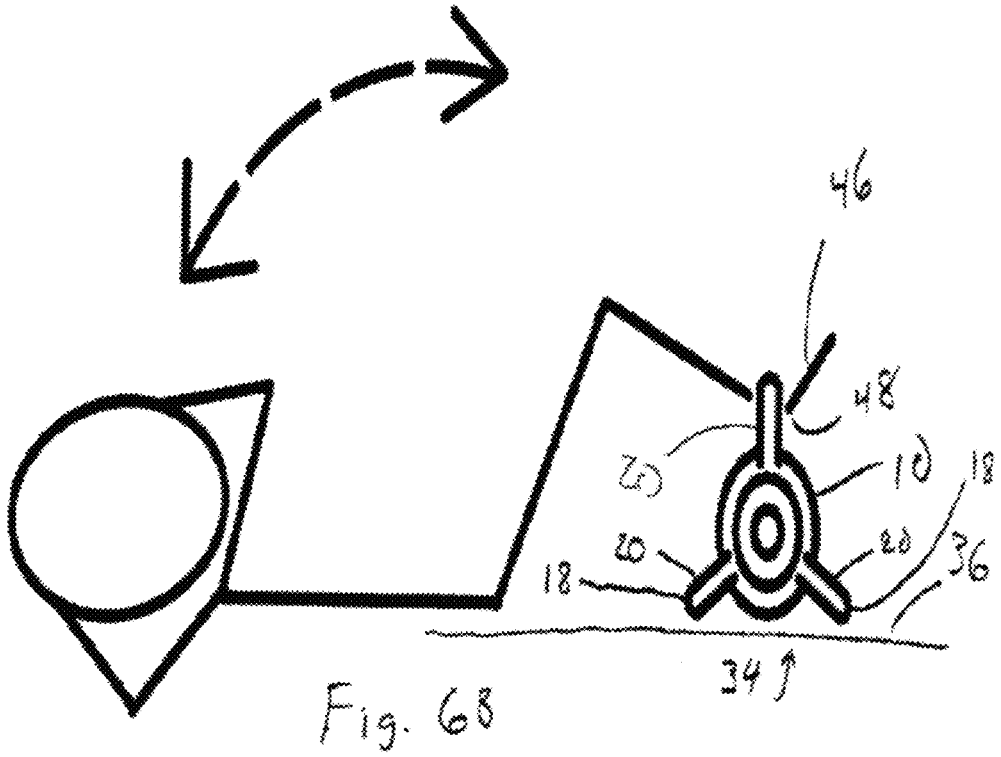
FIG. 6B is a schematic view of the present exercise device being used to perform an alternate version of the sit-up of FIG. 6A.

As shown in FIGS. 6A and 6B, the device 10 is well-suited for sit-ups. One device, or a pair of the devices, 10 is placed on the floor or other support surface 36, with two of the device handles 20 cooperatively at stable rest on the support surface, urging the device into a self-stabilizing rest position 34. A third handle 20 is aligned generally perpendicular to the support surface 36, and a user's foot 46 may pass into the vacant portion of the handle to contact the engagement portion 18. For increased leverage and muscle engagement, the user's heel 48 may engage the outer surface 30 of the body 12 during the exercise. As shown in FIG. 6B, the user's heel 48 need not engage the body 12 of the device 10.

Figure 7:
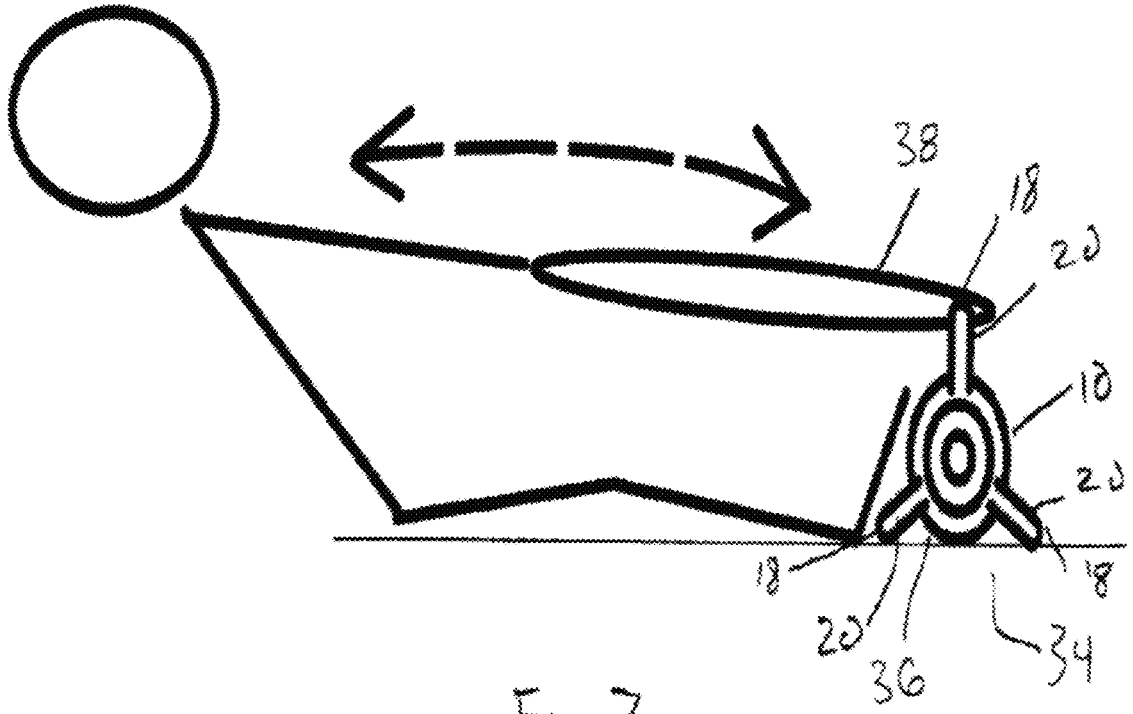
FIG. 7 is a schematic view of the present exercise device being used to perform a reclined row exercise.

As shown in FIG. 7, the device 10 is well-suited for performing reclined rows. One device, or a pair of the devices, 10 is be placed on a support surface 36 where a user 45 is resting; two of the device handles 20 are cooperatively at stable rest on the support surface, urging the device into a self-stabilizing rest position 34, with lower handles 20 of device 10 cooperatively at stable rest on the support surface. Each device 10 could be mounted on a barbell 37, with the barbell providing additional leverage and locations for resting a user's heel 48; the user may also rest his heels directly against the device 10, or heels may simply be placed on the support surface directly. In this embodiment, elastomeric resistance bands 38 are coupled to the handle 20 to provide a source of dynamic, yet stable, resistance for the user during rows.

Figure 8:
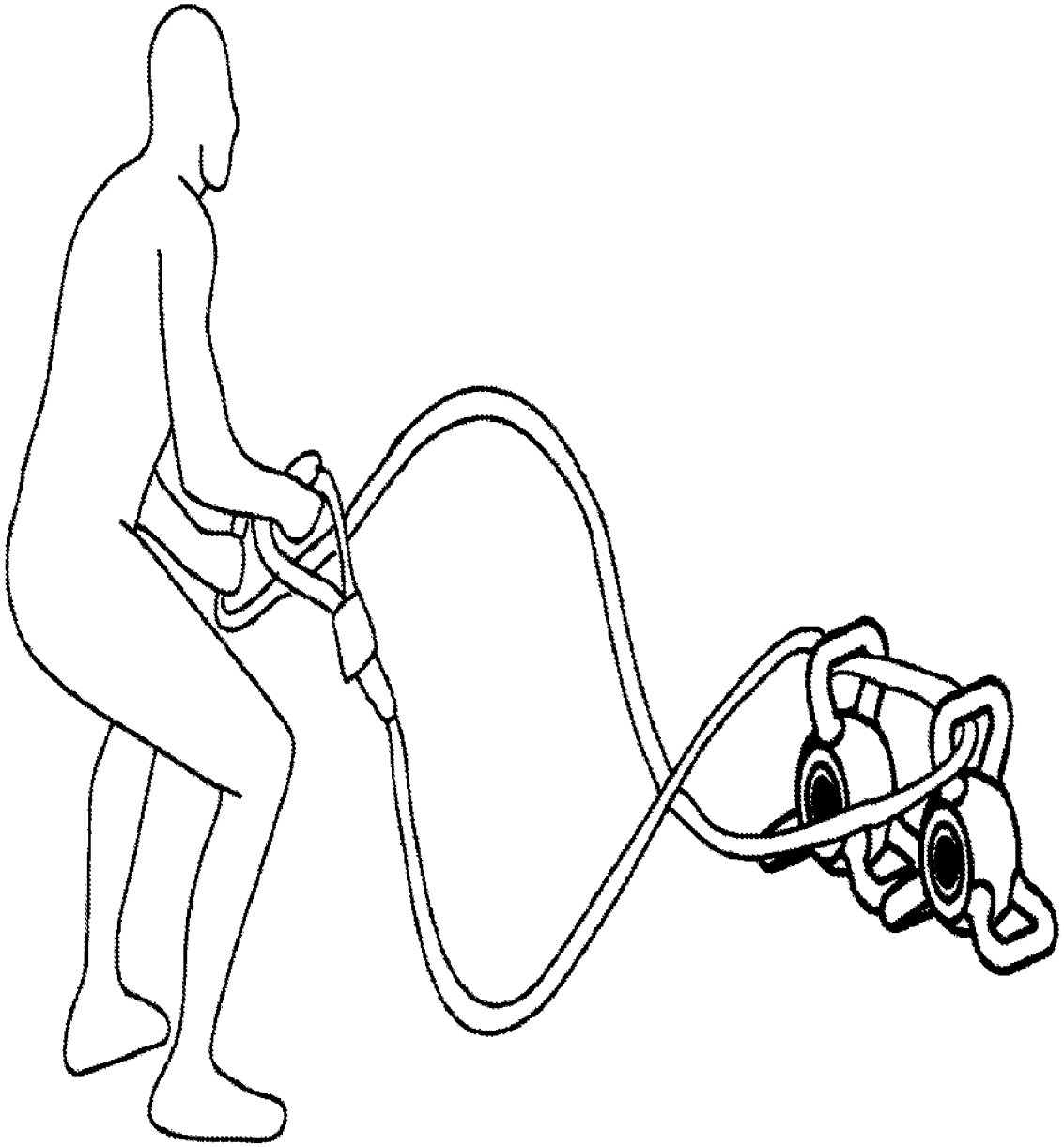
FIG. 8 is a schematic view of the present exercise device being used to perform a battle-rope exercise.

As shown in FIG. 8, the device 10 is well-suited for performing battle-rope exercises. One device, or a pair of the devices, 10 is placed on a support surface 36 where a user 45 is resting; two of the device handles 20 are cooperatively at stable rest on the support surface, positioning the device into a self-stabilizing rest position 34, and weighted ropes may be linked to the handle 20 for oscillation to provide a source of resistance for battle rope exercises. It is noted that although devices 10 of heavy weight are most effective for this exercise, the self-stabilizing nature of the device allows for functionality with moderate and lower weight iterations as well.

As shown in FIG. 9, the device 10 is well-suited for performing bicep curls. One device, or a pair of the devices, 10 is placed on a support surface 36 where a user 45 is standing; two of the device handles 20 are cooperatively at stable rest on the support surface, urging the device into a self-stabilizing rest position 34. Elastomeric resistance 38 bands may be attached to hook-shaped handles 40 (or loop handles 20) and selectively extended in a repeated manner for bicep curl exercises.

Figure 10:
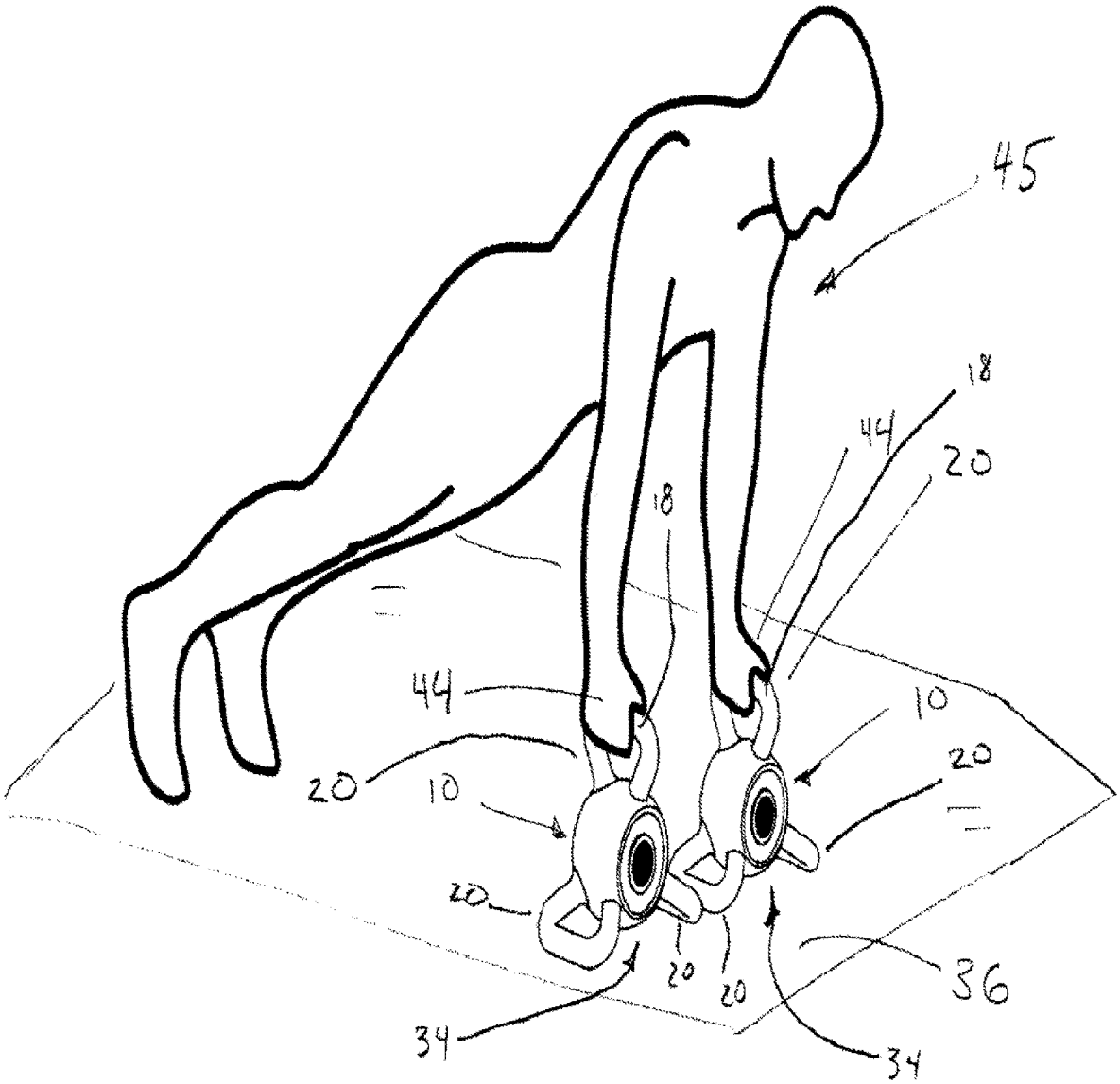
FIG. 10 is a schematic view of the present exercise device being used to perform an assisted pushup exercise.

As shown in FIG. 10, the device 10 is well-suited for performing assisted pushups. One device, or a pair of the devices, 10 is placed on a support surface 36 where a user 45 is prone; two of the device handles 20 are cooperatively at stable rest on the support surface, urging the device into a self-stabilizing rest position 34. The user 45 will grasp the engagement portion 18 of the top-most handle 20 after placing the device 10 in a position and rotational orientation suited to engage muscles the user wants to develop. With this arrangement, the handles 20 provide an elevated, yet stable, interface between user hands 44 and the floor or support surface 42. The self-stabilizing nature of the device 10 safely accommodates a wide degree of user motion without tipping or shifting.

Figure 11A:
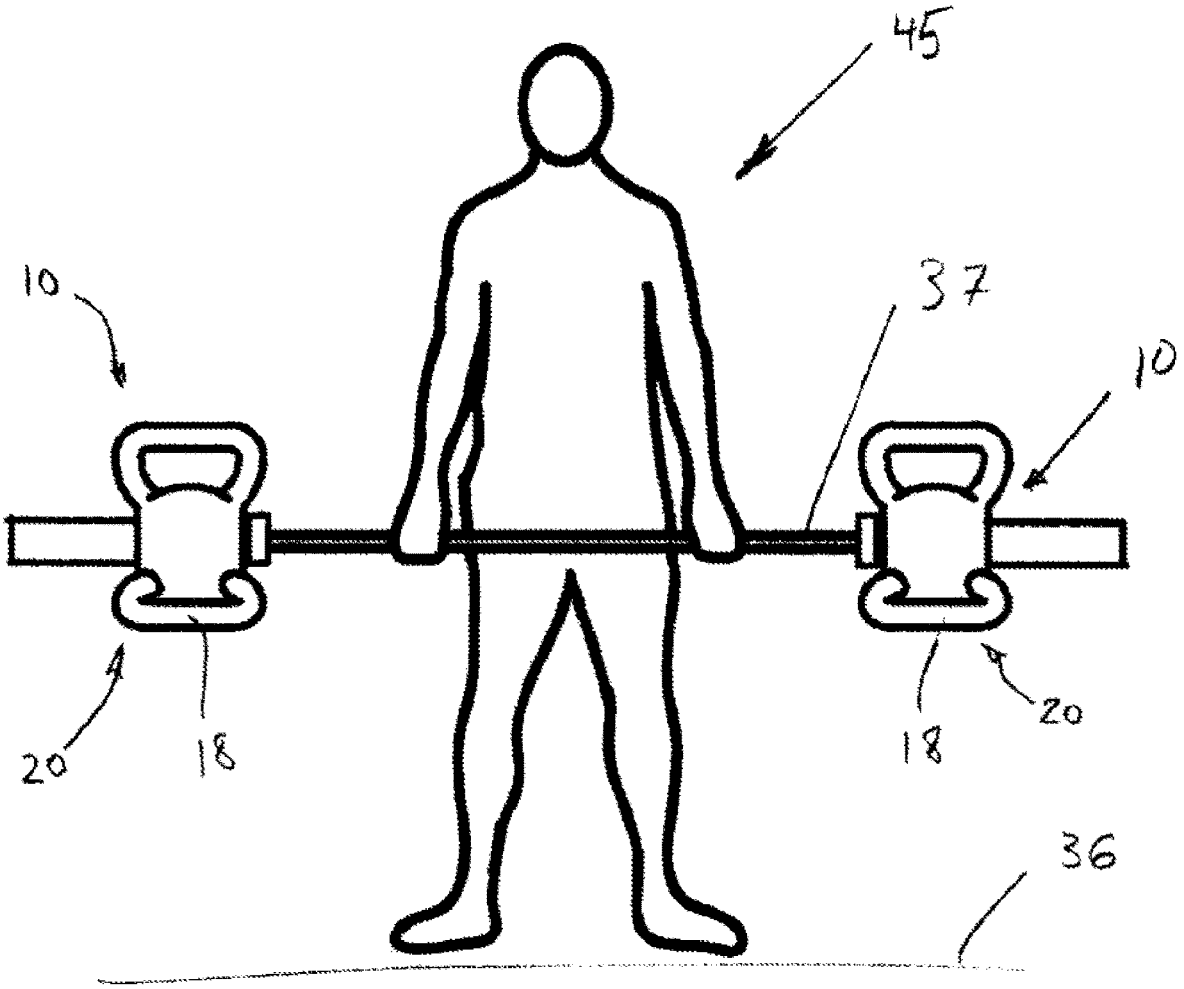
FIG. 11A is a schematic view of the present exercise device being used to perform a deadlift exercise with a barbell.

As shown in FIG. 11A, the device 10 is well-suited for performing a deadlift exercise with a pair of devices 10 placed on a barbell 37. A pair of the devices 10 is slid on a barbell 37 by inserting the barbell through the body elongated bore 14 until the devices are in a position suitable for grasping by a user 45. Before beginning the exercise, the device 10 and barbell 37 combination may be placed, and maintained safely, at stable rest simply by lowering the combination onto the floor or support surface 36 until two handles 20 on each device 10 contacts the floor. As the combination is lowered, the self-stabilizing nature of the device 10 and handles 20 allows the device to rotate circumferentially about the barbell 37 until the engagement portion 18 of two handles 20 of each device 10 move into contact with the floor, and each of the devices adopts a respective self-stabilizing rest position (not shown), with two of the device handles 20 of each device cooperatively at stable rest on the support surface. The user then performs a deadlift exercise in the typical fashion. At the end of each set of repetitions (or any time selected by the user), the combination is lowered, and the self-stabilizing nature of the device 10 and handles 20 again allows the device to spin circumferentially about the barbell 37 until the engagement portion 18 of two handles 20 of each device moves into contact with the floor, and each of the devices adopts a respective self-stabilizing rest position.

Figure 11B:
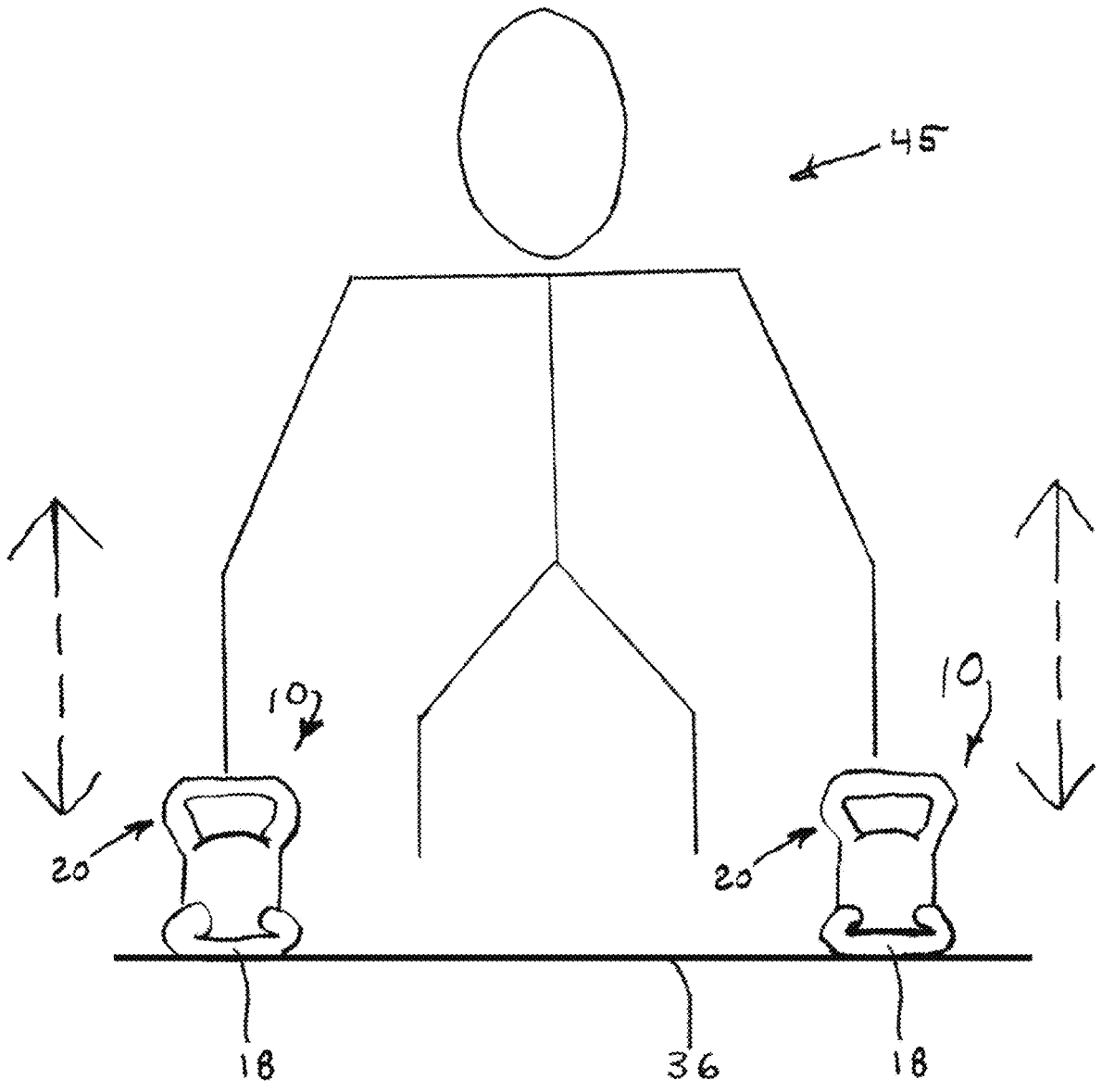
FIG. 11B is a schematic view of the present exercise device being used to perform a deadlift exercise while grasping the device handle.

As shown in FIG. 11B, the device 10 is well-suited for performing a deadlift exercise while directly grasping top handles 20 of the device. A pair of the devices 10 is placed on a floor or other support surface 36, spaced apart as appropriate for a given user—often this is should-width apart—with two lower handles 20 on each device 10 contacting the support surface to automatically adopt self-stabilizing rest position, in which two handles 20 of each device 10 are cooperatively at stable rest on the support surface. The user then performs a deadlift exercise in the typical fashion. At the end of each set of repetitions (or any time selected by the user), the device 10 may be lowered, and the self-stabilizing nature of the device 10 and handles 20 again allows the engagement portion 18 of two handles 20 to move into contact with the floor, with the respective devices automatically adopting a self-stabilizing rest position.

Figure 12:
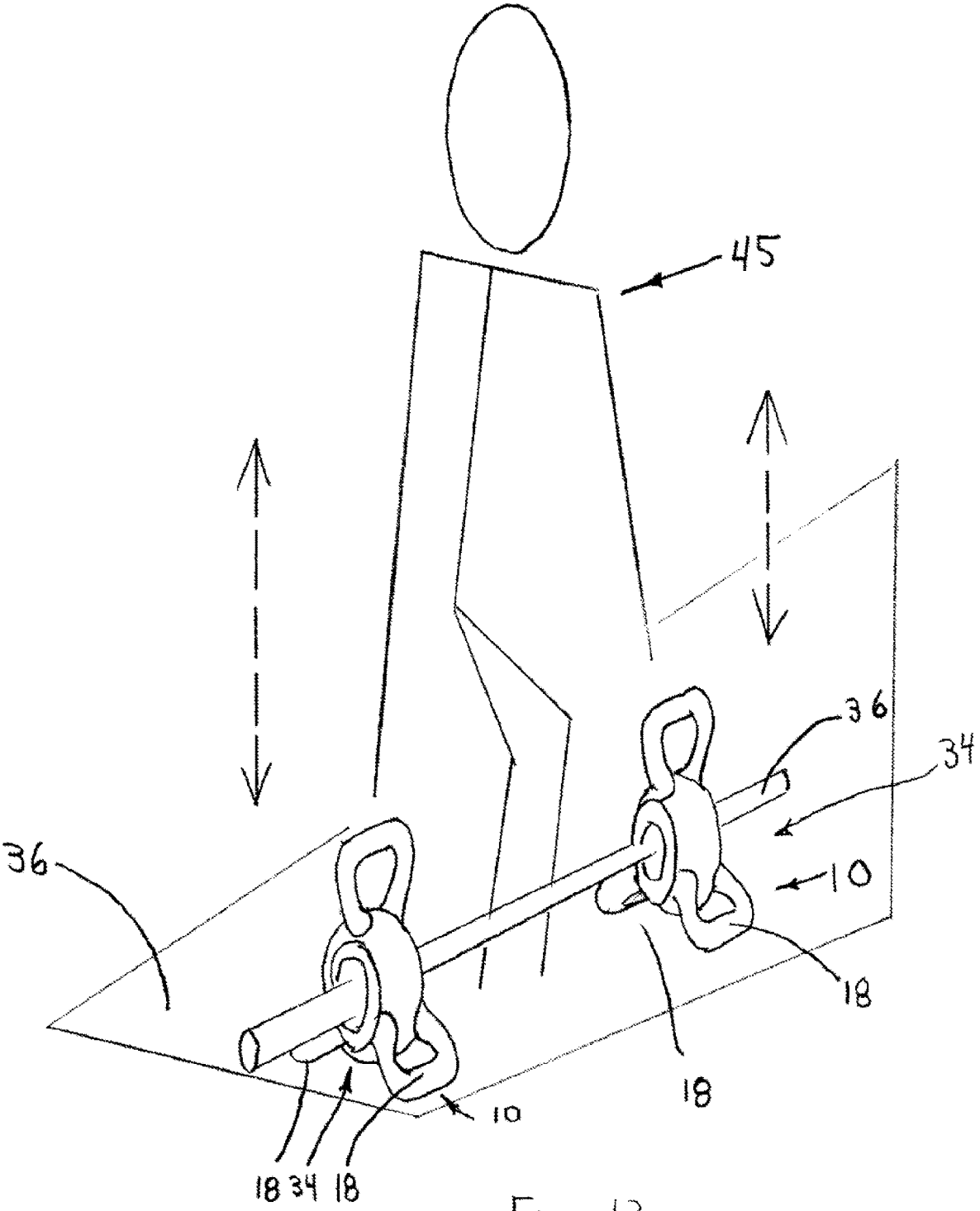
FIG. 12 is a schematic view of the present exercise device being used to perform a bent-over row exercise.

As shown in FIG. 12, the device 10 is well-suited for performing a perform a bent-over row exercise. A pair of the devices 10 is placed on a barbell 37 by inserting the barbell through the body elongated bore 14 and moving them into a position suitable for grasping by a user 45. Before beginning the exercise, the device 10 and barbell 37 combination may be placed and maintained safely at stable rest simply by lowering the combination onto the floor or support surface 36 until two handles 20 on each device 10 contacts the floor. As the combination is lowered, the self-stabilizing nature of the device 10 and handles 20 allows the device to rotate circumferentially about the barbell 37 until the engagement portion 18 of two handles 20 move into contact with the floor, and each of the devices adopts a self-stabilizing rest position (not shown), with two of the device handles 20 cooperatively at stable rest on the support surface. The user then performs a bent-over row exercise in the typical fashion. At the end of each set of repetitions (or any time selected by the user), the combination is lowered, and the self-stabilizing nature of the device 10 and handles 20 again allows the device to spin circumferentially about the barbell 37 until the engagement portion 18 of two handles 20 moves into contact with the floor and each of the devices adopts a self-stabilizing rest position.

Figure 13:
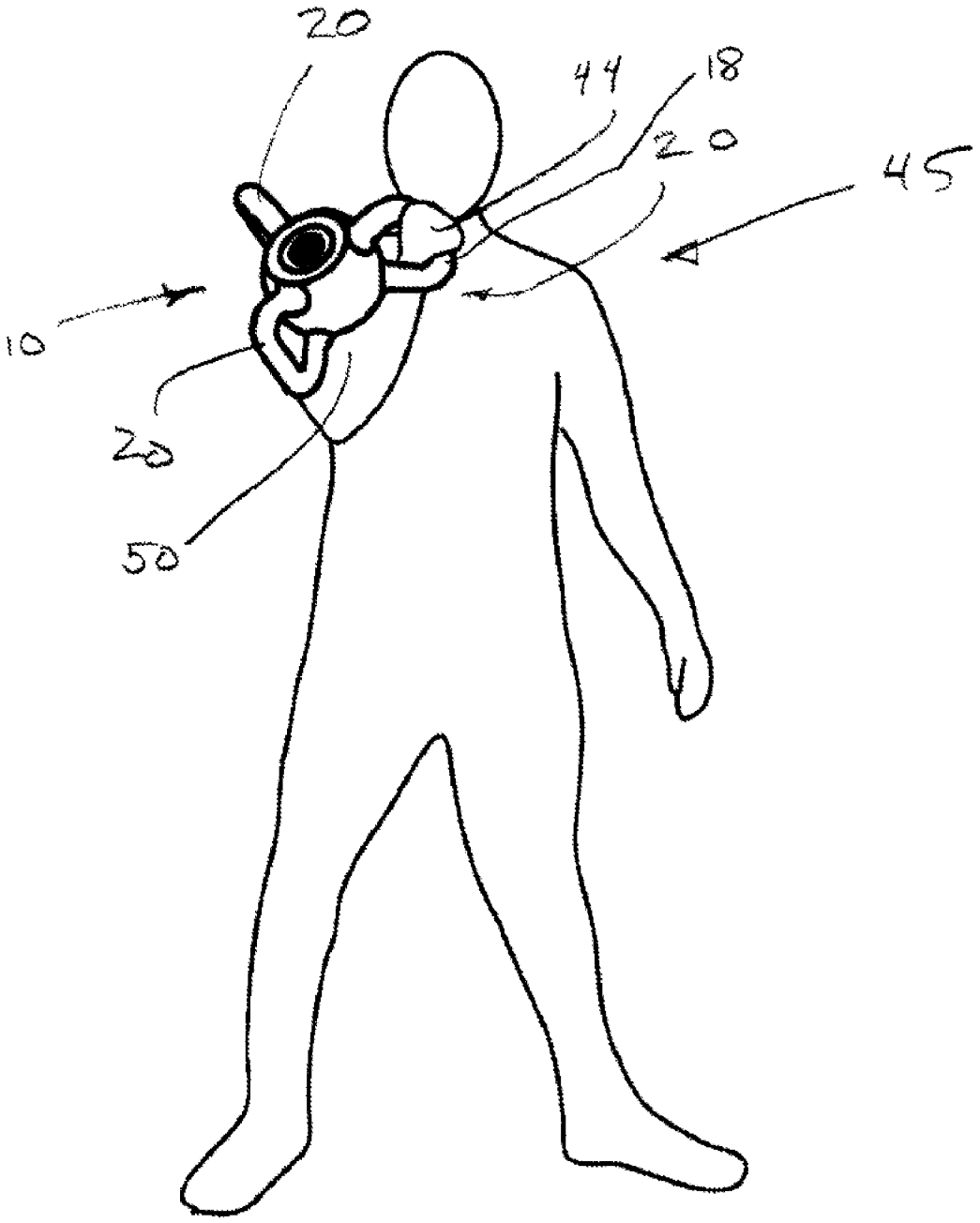
FIG. 13 is a schematic view of the present exercise device in preparation for use in performing a squat-style exercise.

As shown in FIG. 13, the device 10 is well-suited for performing a squat-style exercise, with the device 10 being placed at stable rest by grasping a topmost handle 20 and resting the body 12 and remaining handles against the user's arm 50. Squat-style exercises may then be performed in a typical fashion, while keeping the device secured in an ergonomically-friendly manner.

Figure 14:
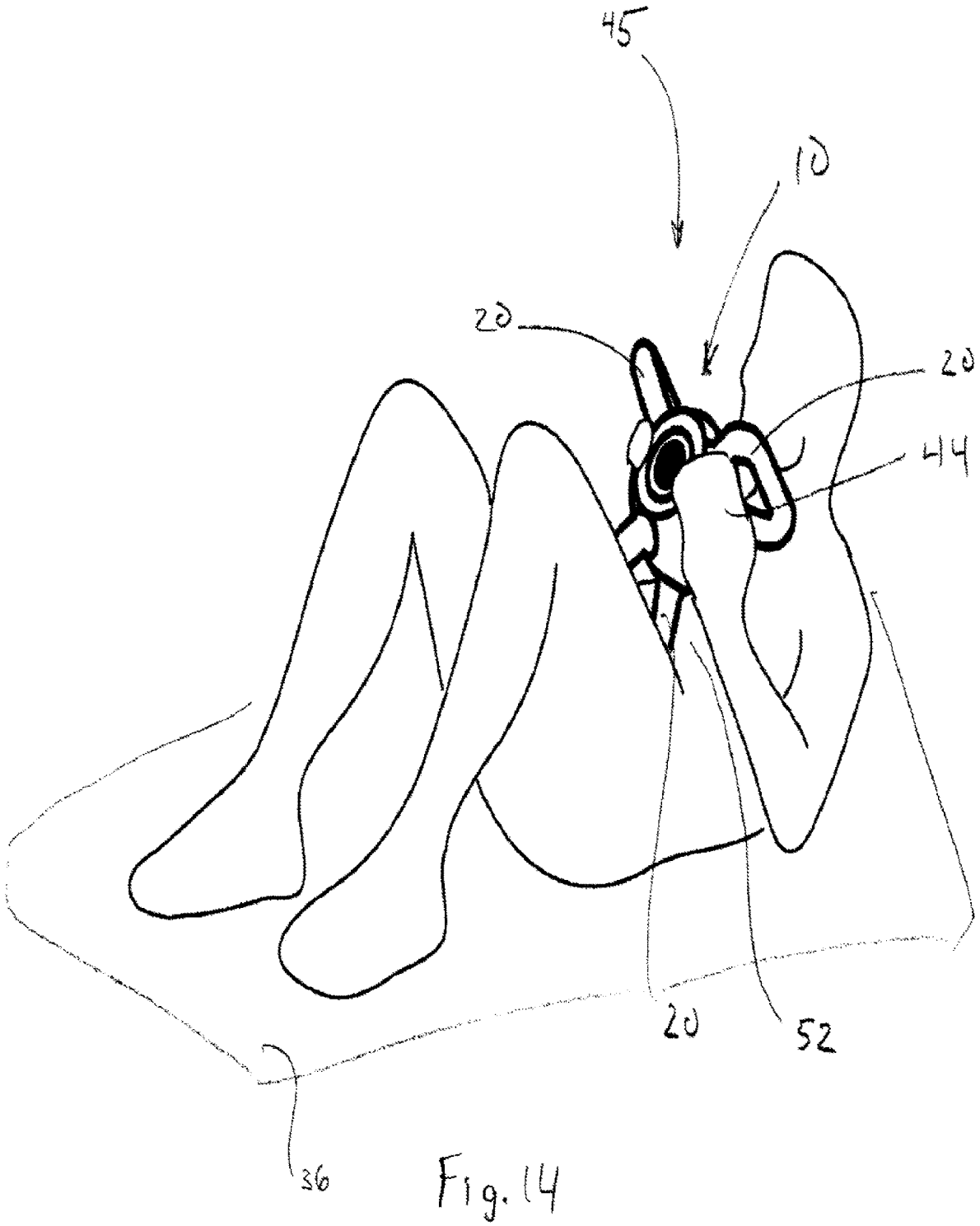
FIG. 14 is a schematic view of the present exercise device being used to perform a weighted crunch or sit up exercise.

As shown in FIG. 14, the device 10 is well-suited for performing a weighted crunch or sit up exercise. The user reclines on a support surface 36 in a typical fashion and securely rests the device 10 against his chest 52, while orienting two handles 20 respectively to either side of his face. This arrangement allows the user 45 to securely hold the device by grasping the body 12 without having the handles dangerously near the user's nose, mouth, or eyes. Sit ups or crunches are then carried out in a typical fashion.

Figure 15A:
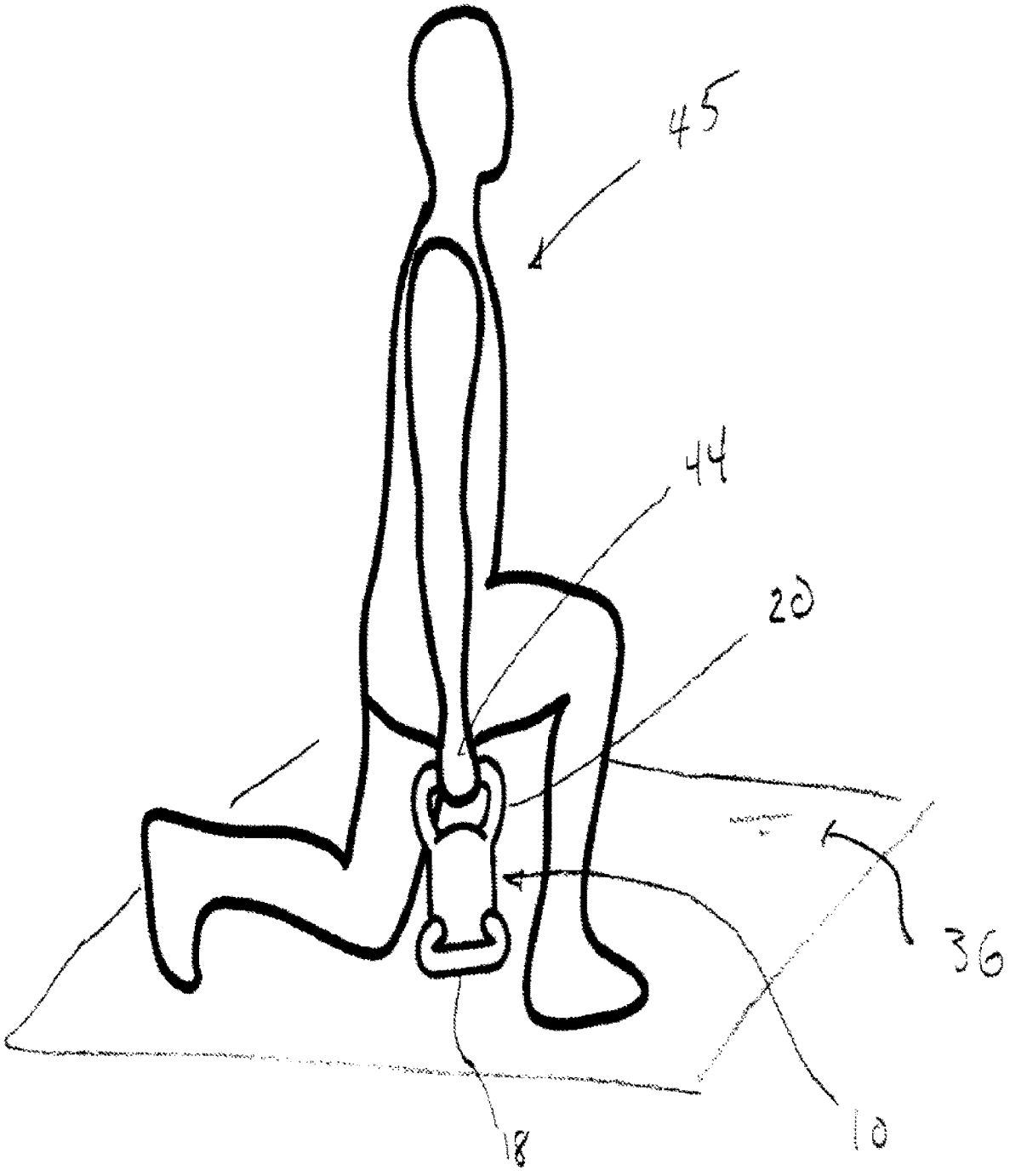
FIG. 15A is a schematic view of the present exercise device being used to perform a lunge exercise.

As shown in FIG. 15*a* the device 10 is well-suited for performing a lunge exercise with palms facing inward. Before conducting a lunge exercise, one or more of the devices 10 is provided, with the engagement portion 18 of two handles 20 cooperatively at stable rest on the support surface. The user grasps the top-most handle of the device 10 with a hand 44 placed in a palm-toward-body orientation and then performs a standard lunge exercise in the typical fashion. At the end of each set of repetitions (or any time selected by the user), the device is lowered, and the self-stabilizing nature of the device 10 and handles 20 again urges the engagement portion 18 of two handles to contact the floor, with the device automatically adopting a self-stabilizing rest position.

Figure 15B:
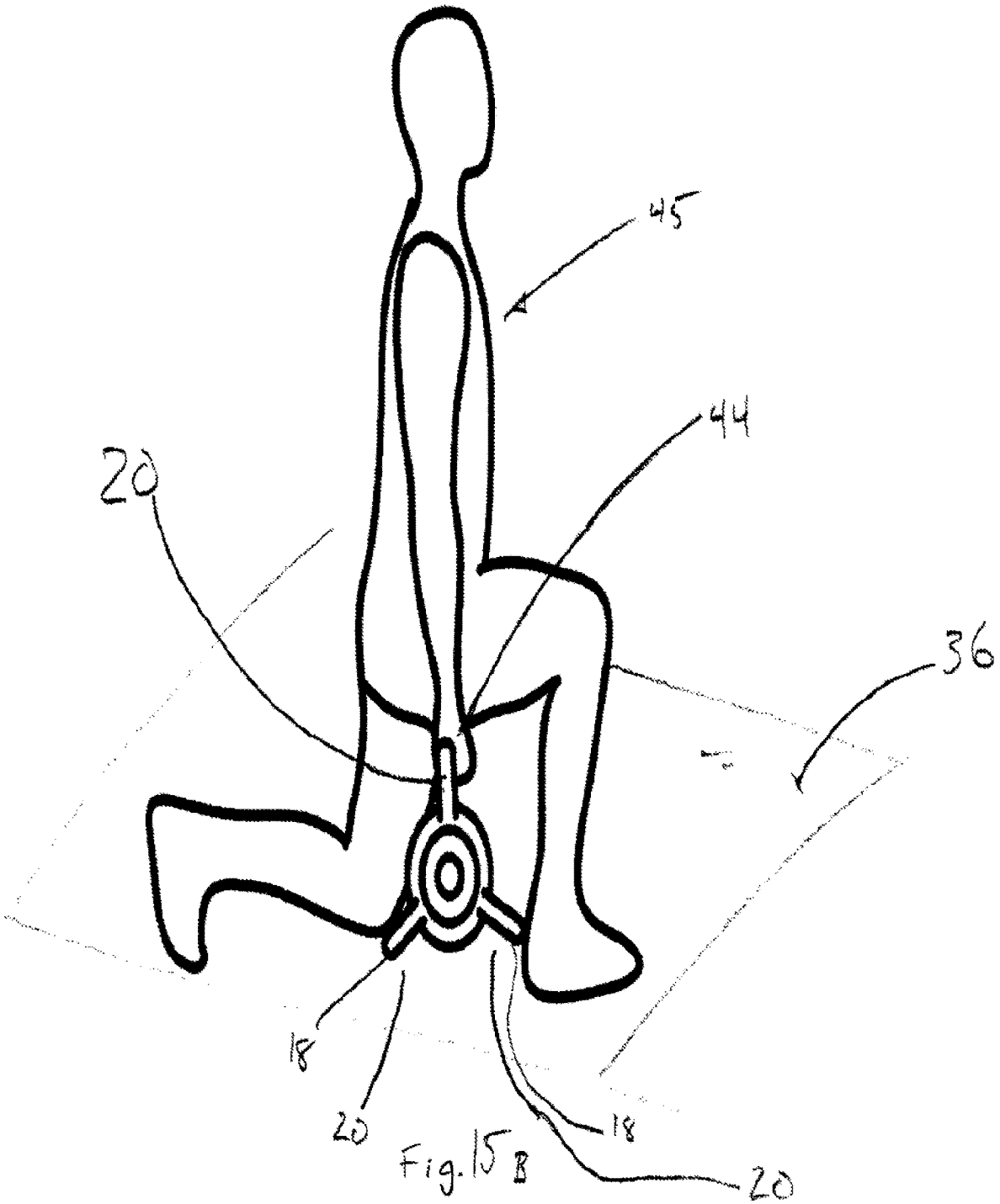
FIG. 15B is a schematic view of the present exercise device being used to perform an alternate grip version of the lunge exercise of FIG. 15A.

As shown in FIG. 15*b*, the device 10 is well-suited for performing an alternate grip lunge exercise with palms facing behind the user. Before conducting a lunge exercise, one or more of the devices 10 is provided, with the engagement portion 18 of two handles 20 cooperatively at stable rest on the support surface. The user grasps the top-most handle of the device 10 with a hand 44 placed in a palm-backward orientation and then performs a standard lunge exercise in the typical fashion. At the end of each set of repetitions (or any time selected by the user), the device is lowered, and the self-stabilizing nature of the device 10 and handles 20 again urges the engagement portion 18 of two handles to contact the floor, with the device automatically adopting a self-stabilizing rest position.

Figure 16A:
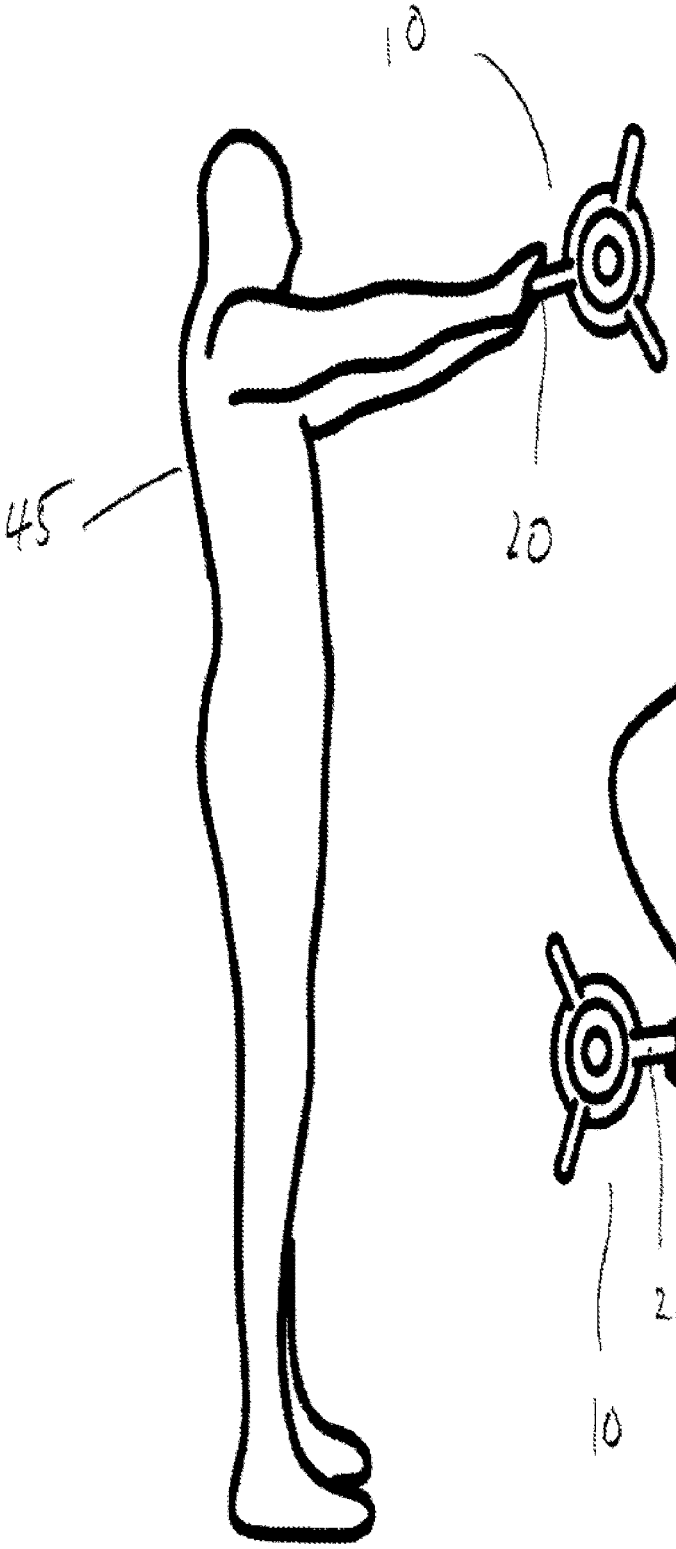
FIG. 16A is a schematic view of the present exercise device being used to perform a forward swing kettlebell exercise.

As shown in FIG. 16A, the device 10 is well-suited for performing a forward swing kettlebell exercise, in which a device 10 is provided, with the user 45 grasping the engagement portion 18 of the device handle 20. The device 10 is swung upward, away from the user in a typical fashion. At the end of each set of repetitions (or any time selected by the user), the device 10 is lowered, and the self-stabilizing nature of the device 10 and handles 20 again urges the engagement portion 18 of two handles to contact the floor, with the device automatically adopting a self-stabilizing rest position.

Figure 16B:
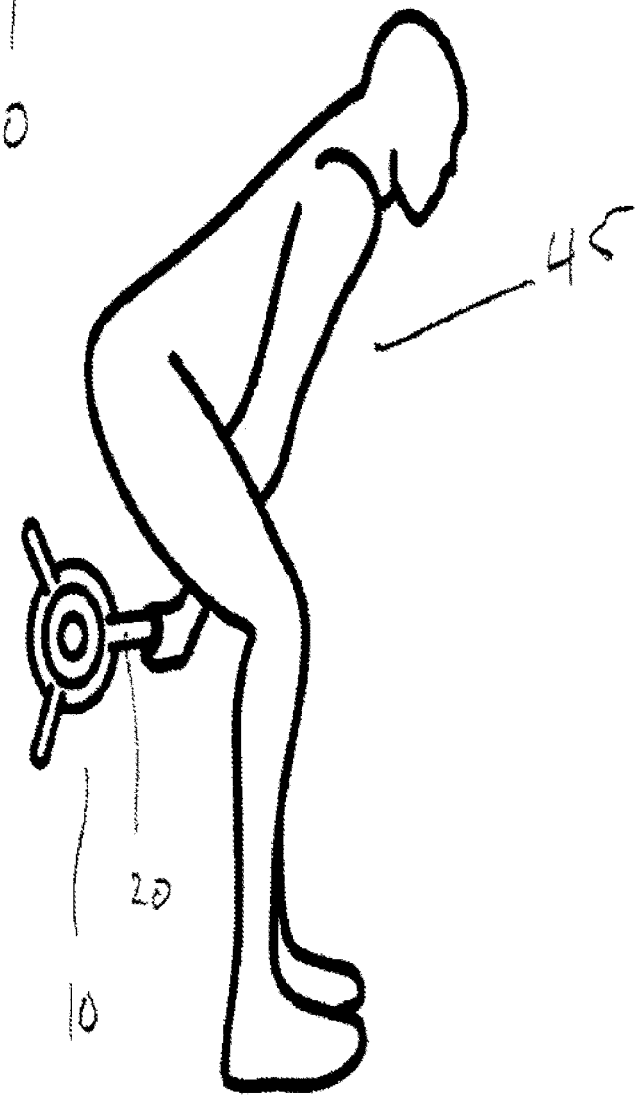
FIG. 16B is a schematic view of the present exercise device being used to perform a between-the-legs kettlebell exercise.

As shown in FIG. 16B, the device 10 is well-suited for performing a between-the-legs kettlebell exercise in which a device 10 is provided, with the user 45 grasping the engagement portion 18 of the device handle 20. The device 10 is swung behind the user, between leg spaced apart in a typical fashion. At the end of each set of repetitions (or any time selected by the user), the device 10 is lowered, and the self-stabilizing nature of the device 10 and handles 20 again urges the engagement portion 18 of two handles to contact the floor, with the device automatically adopting a self-stabilizing rest position.

It is noted that although exercises have been described herein where the user 45 and device 10 share a support surface 36, this is not required for effective conduction of exercises, the device may be placed on a different support surface, and the device will still occupy a self-stabilizing rest position.

Figure 17:
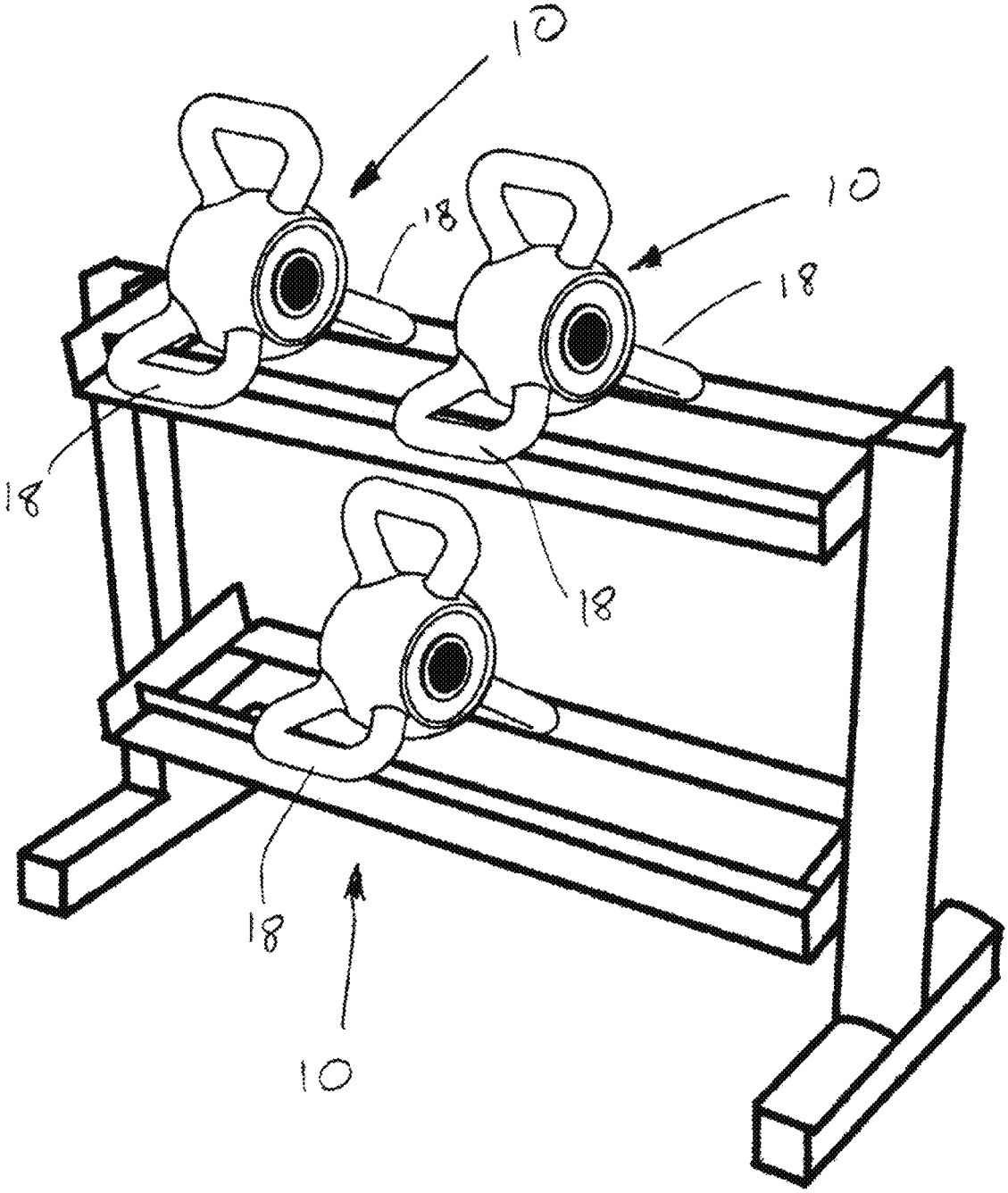
FIG. 17 is a perspective view of the device being stored on a device normally used for dumbbell storage.

It is noted that the device 10 is well-suited for storage in a variety of ways. For example, in addition to storage in a conventional tiered-style and vertically-stacked arrangements, the device may be safely stored on a rack typically used only for dumbbells. As shown in FIG. 17, due to the angled arrangement of the handles 20, the device 10 the device may be placed at stable rest with handle engagement portions 18 placed in recesses typically used to engage the weighted end portions of a hand-held dumbbell.

The above description is intended in an illustrative rather than a restrictive sense. Variations to the exact embodiments described may be apparent to those skilled in the relevant art without departing from the spirit and scope of the claims set out below. It is intended that any such variations be deemed within the scope of this patent.

What is claimed is:

1. A multi-purpose exercise device comprising:

a frusto-spherical body comprising an elongated bore extending along a body central axis, said frusto-spherical body further including a first end surface spaced apart from a second end surface by said elongated bore;

at least three handles extending radially outward from said frusto-spherical body, said at least three handles each including an engagement portion spaced apart from an outer surface of said frusto-spherical body by at least one handle spacing portion extending radially outward from said frusto-spherical body;

each of said at least three handles with said respective at least one handle spacing portion generally defining a respective handle orientation plane that is substantially parallel to said body central axis, wherein said handle orientation planes are uniformly-spaced circumferentially about said body central axis;

whereby said engagement portion and said handle orientation plane of each of said at least three handles are constructed and arranged in a manner effective to provide a plurality of self-stabilizing resting positions that each maintain said body central axis in a substantially-horizontal orientation, each of said plurality of self-stabilizing resting positions being characterized by the engagement portion of two circumferentially-adjacent handles of said at least three handles being oriented for simultaneous support by a horizontally aligned support surface.

2. The multi-purpose exercise device of claim 1, wherein each of said handle orientation planes passes through said elongated bore.

3. The multi-purpose exercise device of claim 1, wherein said at least three handles includes a forth handle.

4. The multi-purpose exercise device of claim 1, wherein each of said at least three handles is sized to accommodate the insertion of an adult hand and gripping of said respective engagement portion by said adult hand.

5. The multi-purpose exercise device of claim 1, wherein at least one of said at least three handles is sized to accommodate the insertion of an adult human foot thereinto to a degree effective to allow said adult human to engage in a sit-up exercise.

6. A method comprising:

providing a first multi-purpose exercise device including a frusto-spherical body comprising an elongated bore extending along a body central axis, said frusto-spherical body further including a first end surface spaced apart from a second end surface by said elongated bore;

at least three handles extending radially outward from said frusto-spherical body, said at least three handles each including an engagement portion spaced apart from an outer surface of said frusto-spherical body by at least one handle spacing portion extending radially outward from said frusto-spherical body;

each of said at least three handles with said respective engagement portion generally defining a respective handle orientation plane that is substantially parallel to said body central axis, wherein said handle orientation planes are uniformly-spaced circumferentially about said body central axis;

whereby said engagement portion and said handle orientation plane of each of said at least three handles are constructed and arranged in a manner effective to provide a plurality of self-stabilizing resting positions that each maintain said body central axis in a substantially-horizontal orientation, each of said plurality of self-stabilizing resting positions being characterized by the engagement portion of two circumferentially-adjacent handles of said at least three handles being oriented for simultaneous support by a horizontally aligned support surface; and placing said first multi-purpose exercise device on a support surface with said elongated bore extending within a plane parallel to said support surface.

7. The method of claim 6, further including steps of a providing a second multi-purpose exercise device comprising an elongated bore and at least one handle with an engagement portion, wherein said second multi-purpose exercise device is substantially identical to said first multi-purpose exercise device;

providing a barbell; and inserting said barbell into the respective elongated bores of said first and second multi-purpose exercise devices, whereby an exercise system is formed.

8. The method of claim 7, further including steps of supporting a user foot against said exercise system, providing an elastomeric band, and connecting said elastomeric band to at least one of said engagement portions of said at least three handles of the first multi-purpose exercise device and said engagement portion of said at least one handle of the second multi-purpose exercise device to perform at least one reclined row.

9. The method of claim 7, further including a step of conducting a bent-over row.

10. The method of claim 7, further including a step of conducting a two-arm long bar row.

11. The method of claim 7, further including a step of conducting a deadlift.

12. The method of claim 6, further including a step of inserting a user foot into one of said at least three handles to engage said corresponding engagement portion to perform at least one sit-up.

13. The method of claim 12, further including a step of resting said user foot against said first multi-purpose exercise device.

14. The method of claim 6, further including a step of providing an elastomeric band and connecting said elastomeric band to at least one of said engagement portions of said at least three handles to perform at least one reclined row.

15. The method of claim 6, further including a step of providing a weighted rope and connecting said weighted rope to at least one of said engagement portions of said at least three handles to perform at least one battle-rope oscillation.

16. The method of claim 6, further including a step of providing an elastomeric band and connecting said elastomeric band to at least one of said engagement portions of said at least three handles to perform at least one bicep curl.

17. The method of claim 6, further including a step of using said first multi-purpose exercise device for arm support in at least one push-up.

18. The method of claim 6, further including a step of performing at least one forward swing kettlebell exercise.

19. The method of claim 6, further including a step of performing at least one between-the-leg kettlebell exercise.

20. The method of claim 6, further including a step of performing at least one crunch exercise.

* * * * *